US009828226B1

(12) United States Patent
Andres

(10) Patent No.: US 9,828,226 B1
(45) Date of Patent: Nov. 28, 2017

(54) BEVERAGE DISPENSER COMPRESSED GAS DELIVERY ADAPTER SYSTEM

(71) Applicant: Ronald Larry Andres, Sacramento, CA (US)

(72) Inventor: Ronald Larry Andres, Sacramento, CA (US)

( * ) Notice: Subject to any disclaimer, the term of this patent is extended or adjusted under 35 U.S.C. 154(b) by 0 days.

(21) Appl. No.: 14/860,596

(22) Filed: Sep. 21, 2015

Related U.S. Application Data

(60) Provisional application No. 62/053,253, filed on Sep. 22, 2014.

(51) Int. Cl.
*B67D 1/04* (2006.01)
*B67D 1/06* (2006.01)
*B67D 1/00* (2006.01)

(52) U.S. Cl.
CPC ..... *B67D 1/04* (2013.01); *B67D 1/06* (2013.01); *B67D 1/0412* (2013.01); *B67D 1/0418* (2013.01); *B67D 1/0425* (2013.01); *B67D 1/0431* (2013.01); *B67D 1/0437* (2013.01); *B67D 2001/0092* (2013.01); *B67D 2001/0098* (2013.01); *B67D 2001/0481* (2013.01)

(58) Field of Classification Search
CPC ..... B67D 1/04; B67D 1/0412; B67D 1/0418; B67D 1/0425; B67D 1/0431; B67D 1/0437; B67D 1/06
USPC ..... 141/64, 302; 222/1, 3–5, 394, 396, 399, 222/400.7
See application file for complete search history.

(56) References Cited

U.S. PATENT DOCUMENTS 2,160,043 A * 5/1939 Threm ..... B67D 1/0412 222/183
3,976,221 A * 8/1976 Martin ..... B67D 1/0412 138/40
3,986,535 A * 10/1976 Meckstroth ..... C12G 1/06 141/113
4,126,161 A * 11/1978 Sterling ..... B60S 5/043 141/302
4,228,933 A * 10/1980 Elson ..... B05B 9/0805 222/400.7
4,406,314 A * 9/1983 Gomersall ..... B67D 1/04 141/302
4,702,396 A * 10/1987 Gwiazda ..... B65D 83/66 215/311

(Continued)

*Primary Examiner* — Paul R Durand
*Assistant Examiner* — Andrew P Bainbridge
(74) *Attorney, Agent, or Firm* — Dennis A. DeBoo

(57) ABSTRACT

A compressed gas delivery adapter for use with a conventional self contained gas-powered beverage dispensing device is operative to couple the beverage dispensing device to an external source of compressed gas. The compressed gas delivery adapter is structured at one end to attach to a conventional self contained gas-powered beverage dispensing device, while mating with and sealing against an annular seal of the beverage dispensing device which typically engages an annular tip of a standard cylindrical 6.5 gram cartridge of compressed gas. At the other end, the compressed gas delivery adapter is configured to receive a hose that is connected to a larger, external compressed gas supply. In this regard, the compressed gas delivery adapter facilitates the delivery of compressed gas from an external gas supply, which may be of any size, to the conventional self contained gas-powered beverage dispensing device.

10 Claims, 3 Drawing Sheets

(56) References Cited

U.S. PATENT DOCUMENTS

| | | | | | |
|---|---|---|---|---|---|
| 5,022,565 | A * | 6/1991 | Sturman | B67D 1/0412 | 222/396 |
| 5,458,165 | A * | 10/1995 | Liebmann, Jr. | B65B 31/04 | 141/19 |
| 6,036,054 | A * | 3/2000 | Grill | B01F 3/04808 | 141/64 |
| 6,216,921 | B1 * | 4/2001 | Spruill | A21O 5/006 | 222/399 |
| 6,530,401 | B1 * | 3/2003 | Angehrn | B65B 3/18 | 141/302 |
| 7,100,799 | B2 * | 9/2006 | Gruenewald | A47J 43/121 | 222/1 |
| 7,273,069 | B1 * | 9/2007 | Nelson | B67D 1/1252 | 137/613 |
| 8,020,588 | B2 * | 9/2011 | Wang | B29C 73/166 | 141/100 |
| 8,348,097 | B2 * | 1/2013 | Nishino | B67D 1/04 | 222/113 |
| 2010/0155419 | A1 * | 6/2010 | Nishino | B67D 1/04 | 222/81 |
| 2011/0204093 | A1 * | 8/2011 | Lee | B67D 1/0004 | 222/152 |

* cited by examiner

BEVERAGE DISPENSER COMPRESSED GAS DELIVERY ADAPTER SYSTEM

CROSS REFERENCE TO RELATED APPLICATIONS

This application claims the benefit of and incorporates by reference U.S. provisional patent application Ser. No. 62/053,253 filed Sep. 22, 2014.

BACKGROUND OF THE INVENTION

Field of the Invention

The present invention relates generally to an adapter for a low pressure compressed gas powered device designed for beverage dispensing and, more particularly, a compressed gas delivery adapter for a wine extraction and preservation device employing pressurized Argon gas to extract a volume of liquid from a bottle or other container.

Description of the Prior Art

Devices for extracting liquids, such as wine, from a sealed bottle using pressurized gas, such as Nitrogen or Argon delivered, sourced from an attachable disposable container are well established. In typical embodiments of gas-powered beverage dispensing devices of the type that do not require removal of the cork or seal of the beverage container, compressed gas to be introduced to a generally sealed bottle or container through a hollow tube inserted therein to enable pressurized liquid to be extracted. Many conventional gas-powered beverage dispensing devices are self contained, using a standard 6.5 gram metal cartridge of compressed gas (oftentimes, Argon) which is removably disposed within a hollow body of the device, typically referred to as the handle (or cup), in order to supply the requisite compressed gas. Accordingly, the handle include a cavity sufficient to receive a standard cylindrical 6.5 gram cartridge of compressed gas. Attaching and tightening the handle with the contained cartridge to the beverage dispensing device engages the gas discharge nipple (or nozzle) of the 6.5 gram cartridge with the beverage dispensing device, thereby forming an airtight seal between an annular tip of the gas discharge nipple and an annular seal inside the beverage dispensing device.

Naturally, such a 6.5 gram gas cartridge will have a limited useful life cycle. Indeed, it is common for conventional 6.5 gram cartridges to only provide 10-15 average sized pours of liquid before the cartridge is exhausted. Once exhausted, the cartridge must be removed and can be disposed, but it must be replaced with a fresh cartridge in order for the gas-powered beverage dispensing device to be used to dispense more liquid.

There exist larger, alternate gas-powered beverage dispensing devices, designed to be connected to a larger source of compressed gas through hoses and fittings or other threaded connections, so as to provide access to a larger supply of compressed gas and ultimately, more pours between each replacement. Such larger devices and their associated compressed gas sources and plumbing are typically more costly than the self-contained devices which utilize a 6.5 gram disposable cartridge. Accordingly, users of self-contained devices who seek the ability to pour a large number of glasses of a beverage without the ever-increasing inconvenience of having to reload gas cartridges so often generally have had no alternatives. Thus, there remains a need for an alternate gas delivery system which would enable owners of existing self-contained gas powered devices, designed to be powered by 6.5 gram gas cartridges, to adapt their device, at reasonable cost, so that the device can be powered by a greater source of compressed gas and/or utilize a refillable cartridge, so as to ultimately lower the costs associated with operating their gas-powered beverage dispensing device.

SUMMARY OF THE INVENTION

A compressed gas delivery adapter for use with a conventional self contained gas-powered beverage dispensing device is operative to couple the beverage dispensing device to an external source of compressed gas. The compressed gas delivery adapter is structured at one end to attach to a conventional self contained gas-powered beverage dispensing device, while mating with and sealing against an annular seal of the beverage dispensing device which typically engages an annular tip of a standard cylindrical 6.5 gram cartridge of compressed gas. At the other end, the compressed gas delivery adapter is configured to receive a hose that is connected to a larger, external compressed gas supply. In this regard, the compressed gas delivery adapter facilitates the delivery of compressed gas from an external gas supply, which may be of any size, to the conventional self contained gas-powered beverage dispensing device.

It is therefore an object of the present invention to provide, for any beverage dispensing device designed to be powered by a standard disposable 6.5 gram cartridge of compressed gas, the ability to quickly connect the beverage dispensing device to a much larger source of compressed gas without significant expense without requiring any temporary or permanent alteration to the beverage dispensing device that would prevent it from being able to quickly return to its original configuration.

Another object of the present invention is to enable users of beverage dispensing devices designed for use with standard 6.5 gram cartridges of compressed gas to significantly increase the volume of liquid available or number of pours which can be made before the supply of compressed gas is exhausted and cartridge replacement is necessary.

These and other objects will be apparent to one of skill in the art.

DETAILED DESCRIPTION OF THE INVENTION

Figure 1:
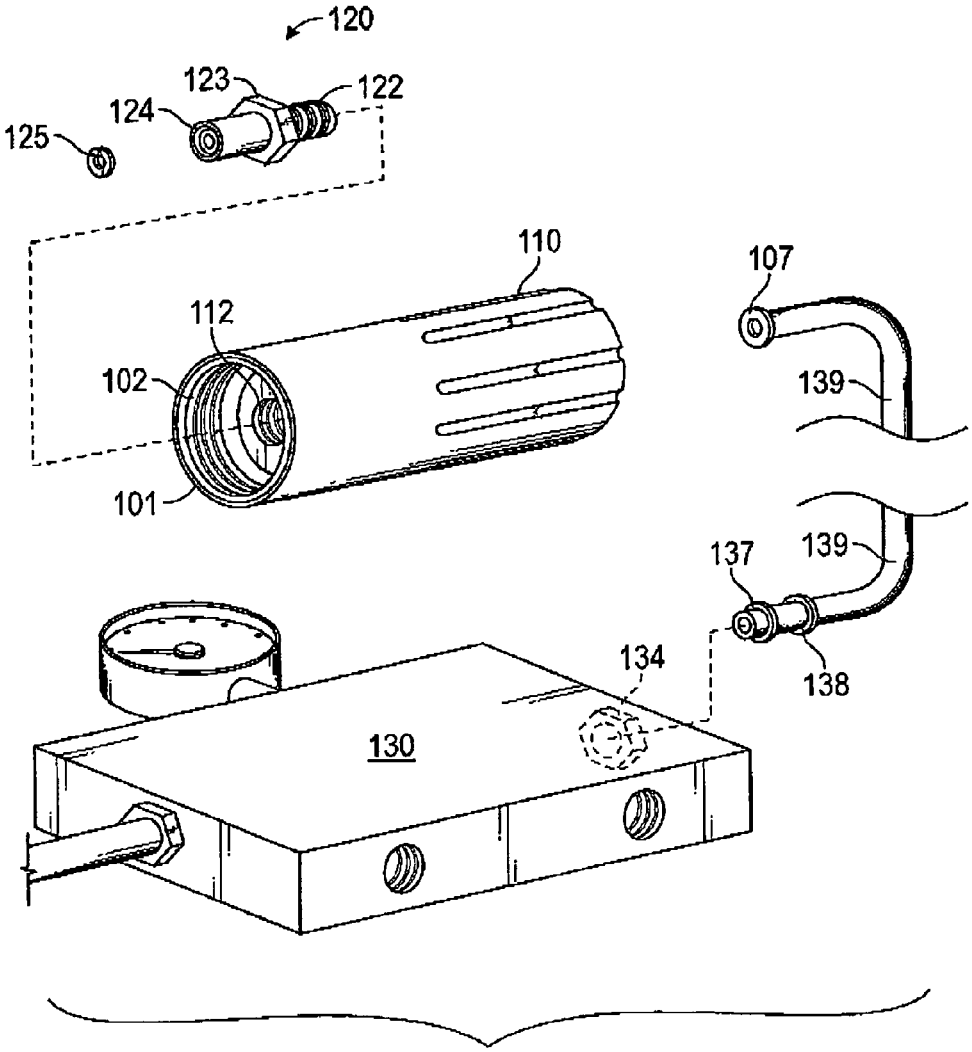
FIG. 1 is an exploded perspective view of a compressed gas delivery adapter built in accordance with the present invention shown with an accompanying gas manifold.

Referring now to the drawings and in particular FIGS. 1, 2, 3, 4, 5, and 6, a compressed gas delivery adapter system is shown as a compressed gas delivery adapter 100 which includes an adapter handle 110 and an adapter insert 120 and a conventional four valve aluminum gas manifold 130. The compressed gas delivery adapter 100 has a top end 101 defined by a cavity with threaded walls 102 and a mating and sealing mechanism centrally disposed therein. The threaded walls 102 allows the compressed gas delivery adapter 100 to attach to self contained gas-powered beverage dispensing device. The mating and sealing mechanism, is embodied as an annular head 124 which includes an integral O-ring 125, is sized to mate with, with the O-ring 125 sealing against, the annular seal inside the beverage dispensing device to which the compressed gas delivery adapter 100 is attached. At its bottom end 105, the compressed gas delivery adapter 100 has bottom threads 106 for attaching a standard female quick connect style gas coupling (also referred to herein as "quick connector" or "quick connects") for receiving a hose, defined as an output tubing 139 (with a corresponding male quick connect 107) connected to the compressed gas supplying device (the gas manifold 130 in the illustrated embodiment). It is appreciated that such a compressed gas delivery adapter 100 is useful for many types of compressed gas driven devices, and particularly beverage dispensing devices designed to be powered by internally housed, standard sized 6.5 gram Argon cartridges.

It is understood that the gas manifold 130 is operative to provide a means for supplying pressurized gas to the compressed gas delivery adapter 100. It is contemplated, however, that while the compressed gas delivery adapter 100 is shown with the gas manifold 130, other conventional compressed gas supplying devices may be used alternatively to supply the requisite compressed gas to the compressed gas delivery adapter 100.

In the preferred embodiment, the adapter insert 120 includes a male output port 121 with a cupped annular head 124 designed to hold an O-ring 125, a hex shoulder 123, and a threaded input port 122. The size of the input port 122, as well as the end threads on the surface thereof adapt the input port 122 to connect into the adapter handle 110 as described below. It is contemplated that the adapter insert 120 may be constructed of Delrin plastic, aluminum or other rigid, durable material.

In the preferred embodiment, the adapter handle 110 defines an elongated cylinder having two bores therein. A first, larger bore extends from the top end 101 to form the cavity that is just deep enough to seat the hex shoulder 123, when the adapter insert 120 is in place in the adapter handle 110, to position the male output port 121 at a depth which mimics the depth of a 6.5 gram cartridge nipple when the cartridge is positioned for use in the handle of a conventional beverage dispensing device. A second, smaller bore extends from the end of the first bore entirely through the adapter handle 110, having a threaded surface 112 at where it begins near the top end 101 of the adapter handle 110 and where it ends near the bottom end 105 of the adapter handle 110. In this regard, the smaller bore provides an integral conduit through which gas can pass through the body of the adapter handle 110. The threaded surface 112 near the top end 101 receives the input port 122 to allow the adapter insert 120 to be attached to the adapter handle 110, while the bottom threads 106 near the bottom accommodates a conventional female quick connect (not shown) which is used to selectively connect a gas supply. It is contemplated that the adapter handle 110 may be constructed of Delrin plastic, aluminum, or other rigid, durable material.

Assembled, the adapter handle 110 and adapter insert 120 combine to form the compressed gas delivery adapter 100 that replaces both a conventional high pressure gas (generally argon) cartridge and the handle which houses the cartridge on the conventional beverage dispensing device. As such, when connected to a supply of compressed gas (typically argon, but any desired gas may be employed), the compressed gas delivery adapter 100 is able to supply low pressure compressed gas directly to an unmodified conventional beverage dispensing device.

Figure 2:
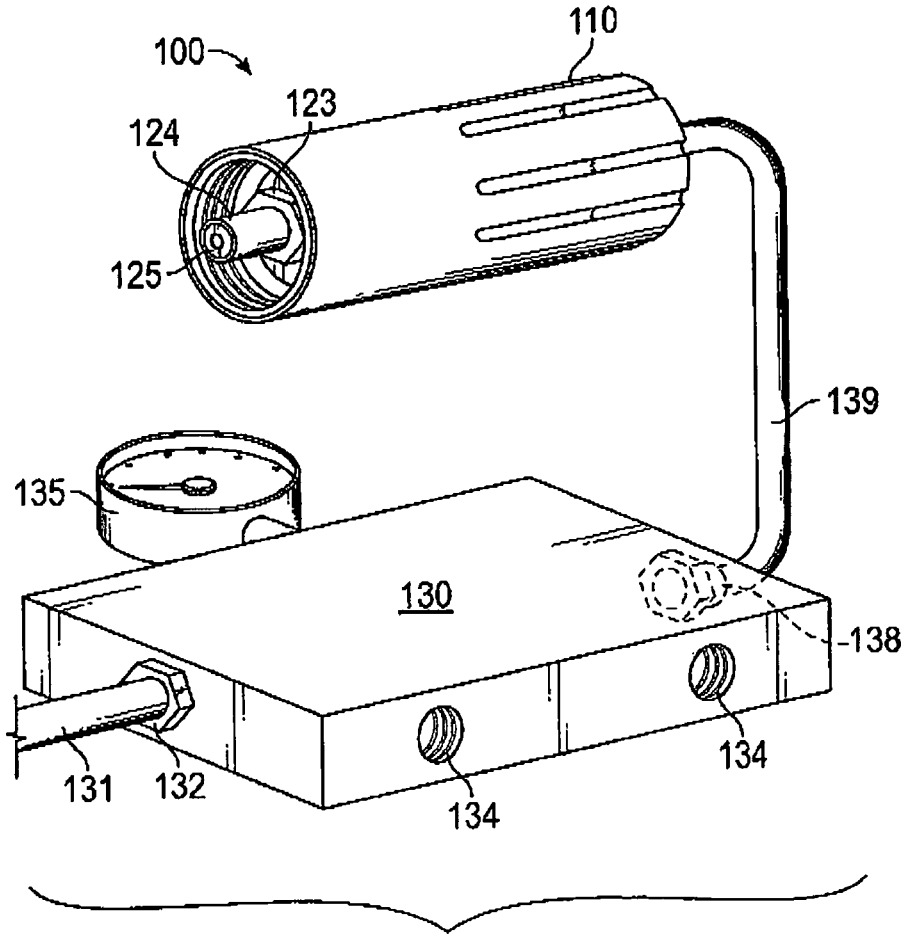
FIG. 2 is a perspective view of a compressed gas delivery adapter built in accordance with the present invention shown with an accompanying gas manifold.
Figure 3:
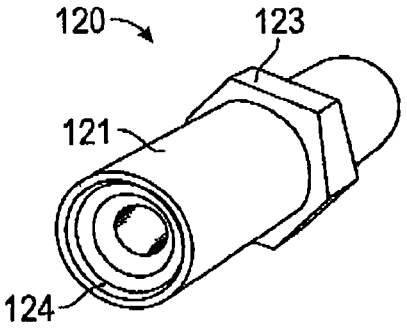
FIG. 3 is a top perspective view of an adapter insert for a compressed gas delivery adapter built in accordance with the present invention.
Figure 4:
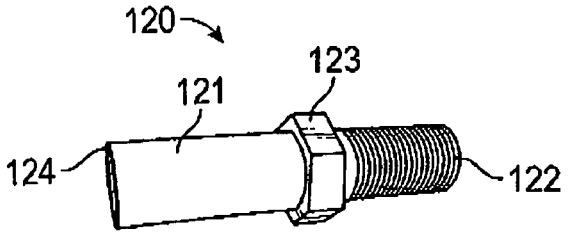
FIG. 4 is a side perspective view of an adapter insert for a compressed gas delivery adapter built in accordance with the present invention.
Figure 5:
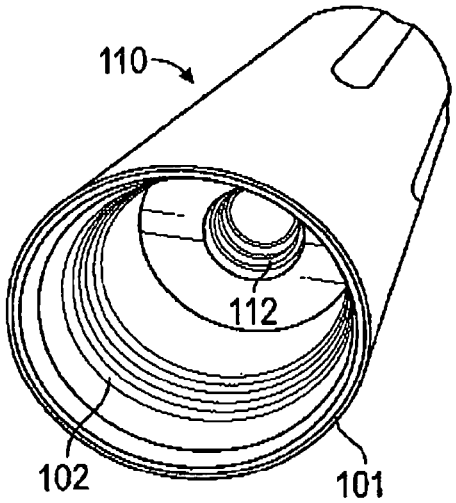
FIG. 5 is a top perspective view of an adapter handle for a compressed gas delivery adapter built in accordance with the present invention.
Figure 6:
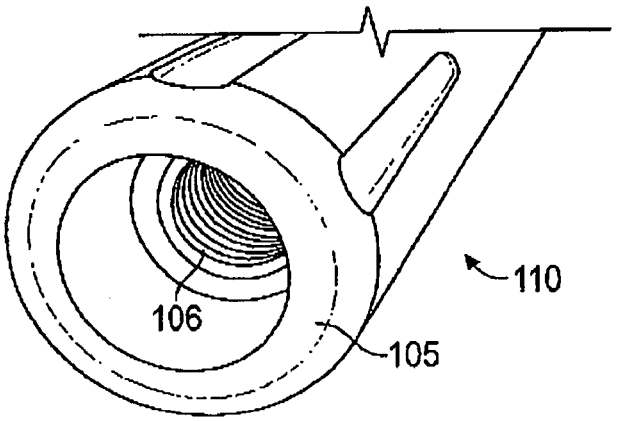
FIG. 6 is a bottom perspective view of an adapter handle for a compressed gas delivery adapter built in accordance with the present invention.

As illustrated in FIG. 2, the complete compressed gas delivery adapter system includes the assembled compressed gas delivery adapter 100 connected to the gas manifold 130 through a flexible output tubing 139. In the preferred embodiment, the output tubing 139 includes a male quick connect 138 with O-ring seals 137 attached at both ends via compression fittings. The output tubing 139 is attached at one end to an output port 134 on the manifold, and at the other end to the female quick connect which has been attached to the bottom end 105 of the adapter handle 110, at the end of the small bore. As such, the output tubing 139 is operative to receive of compressed gas from the manifold 130 and deliver the same to the compressed gas delivery adapter 100.

The threaded walls define 102 with female threads which match the male threads of a conventional beverage dispensing device which typically enable the attachment and tightening of its housing. When the adapter insert 120 is in place in the adapter handle 110, its cupped (and/or threaded) annular head 124 is operative to accept an O-ring 125 which, when tightened against the annular seal inside the beverage dispensing device allows the formation of an airtight seal. It is contemplated that this airtight seal is substantially the same style of airtight seal as that made with the annular tip of the gas cartridge discharge nipple and the annular seal inside the beverage dispensing device.

It is contemplated that a source gas such as high purity argon may be introduced at a low pressure to the manifold 130 from a supply line 131 through a standard compressed gas fitting 132. The flexible output tubing 139 may be of various lengths depending upon needs.

It is contemplated that a low pressure gauge 135 may be employed to indicate the pressure contained within the manifold 130. In addition, the manifold 130 may include additional ports 134 to allow it to accommodate additional industry standard female quick connects with self-contained check valves (as with the port used by the flexible output tubing 139).

In one embodiment, the gas manifold 130 with which the compressed gas delivery adapter 100 is employed is designed to enable 1 to 4 devices to connect to the same source supply of compressed gas (such as argon) without interruption to other dispensing devices already in use.

Advantageously, while conventional gas cartridges of self-contained beverage dispenser devices provide enough compressed gas to deliver 10-15 average size servings before requiring the device owner to replace the small argon gas cartridge, the compressed gas delivery adapter 100 potentially allows for the provision of an unlimited (at least not limited by gas supply) number servings without requiring such replacement maintenance. While some may find the capacity of conventional gas cartridges adequate for personal use situations, there is little dispute that in an circumstance wherein many servings of beverage are desired, whether in rapid succession or over an extended period of time, the hard requirement for frequent cartridge changes can be problematic. Significantly, use of the compressed gas delivery adapter 100 not only allows owners of gas driven dispensing device to connect a reusable cylinder to a larger source of compressed gas and pour beverages without frequent interruptions, it also allows for the use of compressed gas that is delivered to the beverage dispensing device at a much lower (and potentially safer) pressure.

It is appreciated that although a beverage dispensing device handle replacing implementation is described, a compressed gas delivery adapter in accordance with the present invention can be used with any gas powered device having a cavity in any location which normally houses a standard 6.5 gram compressed gas cartridge. In addition, it is understood that the compressed gas delivery adapter may be resized/reshaped and otherwise adapted to accommodate other cartridge sizes. Furthermore, in some embodiments, the gas supply line 131 may take a modified form, defining a larger and/or higher pressure rated hose. Of course, such an embodiment would require additional material and cost, but would work just as well as that shown in the illustrated embodiments.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A compressed gas delivery adapter system for use with a conventional self contained gas-powered beverage dispensing device, comprising:

a compressed gas delivery adapter comprising an adapter handle and an adapter insert, said adapter handle having a first end, a second end, and an integral conduit, wherein said integral conduit is configured to enable a pressurized gas directed therein at a location adjacent to said second end to flow therethrough towards said first end;

said adapter handle having a cavity defined by a circumscribing interior surface of said adapter handle, said cavity having a first bore diameter extending between said first end and a second bore of said integral conduit, said second bore having female threads adjacent said first bore and having a second bore diameter less than said first bore diameter;

said adapter insert comprising a male output port, a threaded input port, and a shoulder located between said male output port and said threaded input port, said threaded input port threadedly coupled to said female threads of said second bore of said integral conduit with said shoulder centrally disposed in said cavity and with said male output port longitudinally extending from said shoulder away from said threaded input port;

said male output port of said adapter insert comprising a cupped annular head configured to hold an O-ring;

a means for supplying the pressurized gas, wherein said means for supplying the pressurized gas is operatively connected to said integral conduit at said second end so as to enable said means for supplying the pressurized gas to direct the pressurized gas into said integral conduit towards said first end; and said first end is configured to attach to a conventional self contained gas-powered beverage dispensing device such that said compressed gas delivery adapter mates and seals with the beverage dispensing device to enable the pressurized gas to be directed towards said first end through said integral conduit and into the beverage dispensing device.

2. The compressed gas delivery adapter system of claim 1, wherein:

said means for supplying the pressurized gas is configured to direct the pressurized gas into said integral conduit towards said first end;

said integral conduit is configured to enable the pressurized gas directed therein at a location adjacent to said second end to flow therethrough towards said first end while maintaining a level of pressure relative to ambient conditions; and said first end is configured such that the pressurized gas directed towards said first end through said integral conduit is directed into the beverage dispensing device while maintaining the level of pressure relative to ambient conditions.

3. The compressed gas delivery adapter system of claim 1, wherein:

said first end is configured to selectively attach, mate and seal with the conventional self contained gas-powered beverage dispensing device; and said compressed gas delivery adapter defines a discrete, removable member relative to the conventional self contained gas-powered beverage dispensing device with which said first end mates and seals.

4. The compressed gas delivery adapter system of claim 1, wherein said second end is configured to receive and sealably attach to an input conduit operative to direct the pressurized gas into said integral conduit, thereby operatively connecting said means for supplying the pressurized gas to said integral conduit at said second end.

5. The compressed gas delivery adapter system of claim 4, wherein said second end is configured to receive and sealably attach to the input conduit through an attachment of a quick connect style gas coupling into said integral conduit at a location adjacent to said second end.

6. The compressed gas delivery adapter system of claim 1, wherein said shoulder of said adapter insert is a hex shoulder.

7. The compressed gas delivery adapter system of claim 5, wherein said first end is configured to attach with the conventional self contained gas-powered beverage dispensing device through an attachment surface integral with said circumscribing interior surface defining said cavity of said adapter handle and wherein said adapter insert is configured to mate and seal with the conventional self contained gas-powered beverage dispensing device through said male output port on said adapter insert.

8. The compressed gas delivery adapter system of claim 7, wherein said adapter handle defines an elongated cylinder.

9. The compressed gas delivery adapter system of claim 7, wherein the threaded input port of said adapter insert enables said adapter insert to direct the pressurized gas in said integral conduit through said male output port of said adapter and into the conventional self contained gas-powered beverage dispensing device with which the first end is mated and sealed.

10. A method for adapting a conventional self contained gas-powered beverage dispensing device to receive compressed gas from an external supply, comprising the steps of:

providing a compressed gas delivery adapter comprising an adapter handle, the adapter handle having a first end, a second end, and an integral conduit, wherein the integral conduit is configured to enable a pressurized gas directed therein at a location adjacent to the second end to flow therethrough towards the first end, the adapter handle having a cavity defined by a circumscribing interior surface of the adapter handle, the cavity having a first bore diameter extending between the first end and a second bore of the integral conduit, the second bore having female threads adjacent the first bore and having a second bore diameter less than the first bore diameter;

providing an adapter insert comprising a male output port, a threaded input port, and a shoulder located between the male output port and the threaded input port, the threaded input port threadedly coupled to the female threads of the second bore of the integral conduit with the shoulder centrally disposed in the cavity and with the male output port longitudinally extending from the shoulder away from the threaded input port; the male output port of the adapter insert comprising a cupped annular head configured for holding an O-ring;

attaching the first end of the adapter handle of the compressed gas delivery adapter to a conventional self contained gas-powered beverage dispensing device, to enable the pressurized gas directed at a location adjacent to the second end to flow through the integral conduit of the adapter handle and through the threaded input port and male output port of the adapter insert to the conventional self contained gas-powered beverage dispensing device; and supplying the pressurized gas to the integral conduit at the second end, thereby directing the pressurized gas through the integral conduit of the adapter handle and through the threaded input port and male output port of the adapter insert to the conventional self contained gas-powered beverage dispensing device.

* * * * *